US009664002B2

(12) United States Patent
Webb

(10) Patent No.: US 9,664,002 B2
(45) Date of Patent: May 30, 2017

(54) PNEUMATIC MUD BUCKET

(71) Applicant: Dustin L Webb, Huntsville, TX (US)

(72) Inventor: Dustin L Webb, Huntsville, TX (US)

( * ) Notice: Subject to any disclaimer, the term of this patent is extended or adjusted under 35 U.S.C. 154(b) by 340 days.

(21) Appl. No.: 14/544,177

(22) Filed: Dec. 5, 2014

(65) Prior Publication Data

US 2015/0176350 A1 Jun. 25, 2015

Related U.S. Application Data

(60) Provisional application No. 61/964,010, filed on Dec. 20, 2013.

(51) Int. Cl.
*E21B 21/01* (2006.01)
*E21B 19/16* (2006.01)

(52) U.S. Cl.
CPC ..... *E21B 19/16* (2013.01); *E21B 21/01* (2013.01)

(58) Field of Classification Search
CPC ..... E21B 19/16; E21B 21/01
See application file for complete search history.

(56) References Cited

U.S. PATENT DOCUMENTS

2005/0205303 A1* 9/2005 Pearson ..... E21B 21/01 175/57
2011/0265992 A1* 11/2011 Pearson ..... E21B 21/01 166/267

* cited by examiner

*Primary Examiner* — Robert E Fuller
*Assistant Examiner* — David Carroll
(74) *Attorney, Agent, or Firm* — Randal D. Homburg

(57) ABSTRACT

A pneumatically operated vertical clam shell mud bucket attaches to a pipe joint connection in a drill stem on a drilling rig, the mud bucket defining a first tubular section forming a half cylinder hingably attaching a second tubular section forming a mirror image half cylinder, the tubular sections forming a sealed cylinder which is forcibly closed together by a plurality of pneumatic cylinders with a composition compression material forming a liquid seal between the closed half cylinders containing drilling fluids during the drilling stem separation and connection diverting drilling fluids to an outer evacuation hose to an external recirculating system on the drilling rig.

3 Claims, 8 Drawing Sheets

PNEUMATIC MUD BUCKET

CROSS REFERENCE TO RELATED APPLICATIONS

Applicant claims the benefit of U.S. Provisional Patent Application No. 61/964,010, filed on Dec. 20, 2013 by the same inventor and assignee.

I. BACKGROUND OF THE INVENTION

1. Field of Invention

A pneumatically operated vertical clam shell mud bucket attaches to a pipe joint connection in a drill stem on a drilling rig, the mud bucket defining a first tubular section forming a half cylinder hingably attaching a second tubular section forming a mirror image half cylinder, the tubular sections forming a sealed cylinder which is forcibly closed together by a plurality of pneumatic cylinders with a composition compression material forming a liquid seal between the closed half cylinders containing drilling fluids during the drilling stem separation and connection diverting drilling fluids to an outer evacuation hose to an external recirculating system on the drilling rig.

2. Description of Prior Art

A preliminary review of prior art patents was conducted by the applicant which reveal prior art patents in a similar field or having similar use. However, the prior art inventions do not disclose the same or similar elements as the present pneumatic mud bucket, nor do they present the material components in a manner contemplated or anticipated in the prior art.

Pneumatic mud buckets are found in the drilling industry and shown in several embodiments on products advertised by Stabil Drill (http://stabildrill.com/products/pneumatic_mud_buckets/) and Sub-Drill (http://sub-drill.com/mud_saver_buckets.html); U.S. Pat. No. 7,306,032 to Paton. These mud buckets perform the same function as the present mud bucket, but possess different embodiments Than that disclosed in the present invention, including the clam shell halves, the perimeter seal and the pneumatic operating system with the rear safety and operational components.

The art of mud buckets dates back to the early days of oil exploration, including an 1880 U.S. Pat. No. 234,825 to Walker, which disclosed a clasp packer to catch residual oil from pipe joints during disassembly. A hinged mud bucket was later patented under U.S. Pat. No. 1,632,889 to Davis, which was the first "clam-shell" design found during the patent search, and was designed to retain oil and to prevent oil spillage, diverting the reclaimed oil to suitable receptacles. Several other hinges section mud buckets with a mechanical clasp are shown in U.S. Pat. No. 5,295,536 to Bode, U.S. Pat. No. 4,450,905 to Crain and U.S. Pat. No. 2,096,882 to Chernosky. A mechanically operated mud bucket is also shown in U.S. Patent Application No 2011/0265992 to Pearson with a pressure system to place a positive pressure within the closed mud bucket for advanced fluid evacuation within the mud bucket. An earlier version of a pressure positive mud bucket is shown in U.S. Pat. No. 2,522,444 to Grable.

The present mud bucket is also a clam-shell style enclosure with two halves forming a cylinder around a pipe joint, however, in this invention, the mud bucket includes a floor and subfloor which enhance complete fluid evacuation and features a pneumatic closure system activated from the rear and side, away from the closure and also includes safety features to isolate the closure mechanism of the mud bucket from incidental contact.

II. SUMMARY OF THE INVENTION

The pneumatic mud bucket is a device delivered by an overhead suspension cable, extension arm or portable wheeled means to a drill stem on a drilling rig, the pneumatic mud bucket attaching to the drill stem over a pipe joint to contain drilling fluids, commonly referenced as drilling mud, which would otherwise leak onto the deck floor posing a hazard to the persons performing work on the deck. The mud bucket secures to the drill stem by two half cylindrical sections closing using a pneumatic means, each half cylinder defining a perimeter groove within which a compressible composition material strip is places to prevent leakage of the drilling fluids which are released from the drilling stem during the disconnection and connection of the drill stem sections from the joint. The fluids are withdrawn from the inner cylinder halves when closed and sealed by at least one fluid aperture forming an external fluid outlet in at least one cylinder half. These withdrawn fluids are sent via an external hose to the mud pump for recycling and reuse in the drilling rig operations.

The primary objective of the invention is to provide the mud bucket with a pneumatic opening and closure. A secondary objective is to provide the mud bucket with the aperture located in a position below the floor for complete evacuation of drilling fluids prior to opening. A third objective is to provide the mud bucket with the perimeter groove containing the composition seal to prevent leakage and also to easily maintain and replace the seal when worn or no longer usable. A fourth objective is to provide safety feature which isolates the pneumatic closure and opening means from contact with the operator and also places the controls for the mud bucket on the back side of the mud bucket, away from the closure.

III. DESCRIPTION OF THE DRAWINGS

The following drawings are submitted with this utility patent application.

FIG. 3 is an inner view of the left cylinder shell.

FIG. 8 is a top view of the pneumatic mud bucket in a closed position.

FIG. 9 is a top view of the pneumatic mud bucket in an open position.

FIG. 12 is a right side view of the pneumatic mud bucket.

FIG. 13 is a left side view of the pneumatic mud bucket showing the side control lever.

IV. DESCRIPTION OF THE PREFERRED EMBODIMENT

Figure 11:
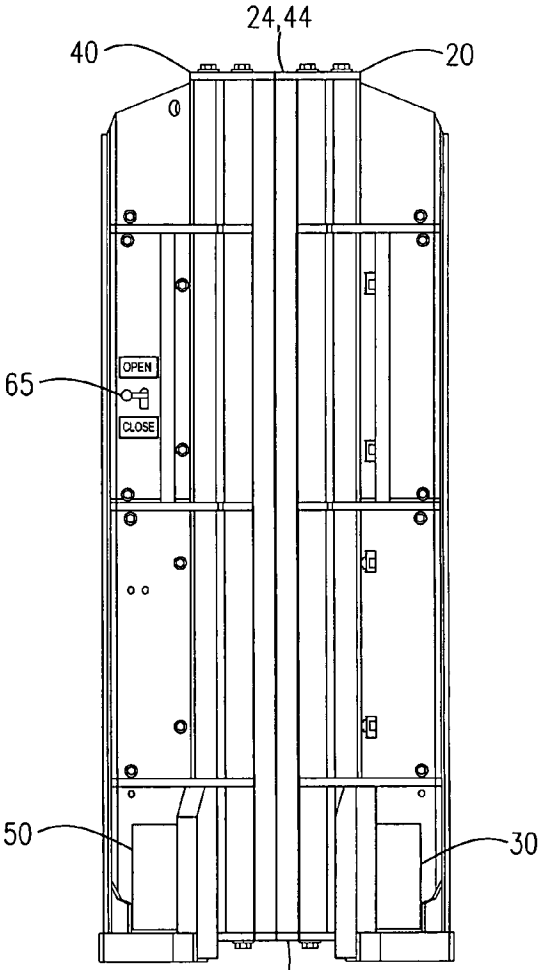
FIG. 11 is a front view of the pneumatic mud bucket in a closed position.
Figure 10:
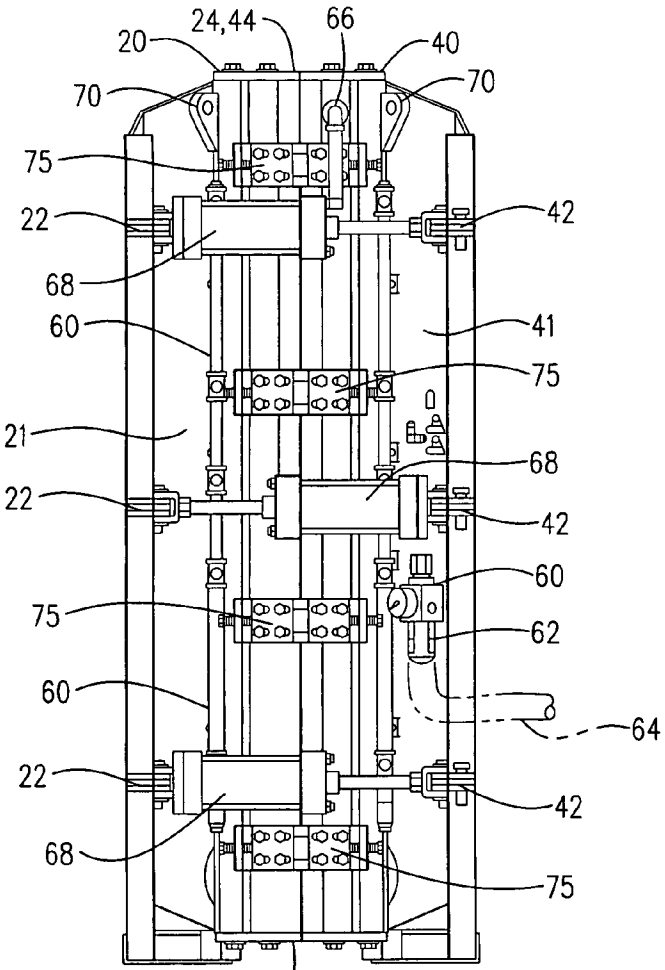
FIG. 10 is a rear view of the pneumatic mud bucket with a phantom line indicating the air hose connection.
Figure 15:
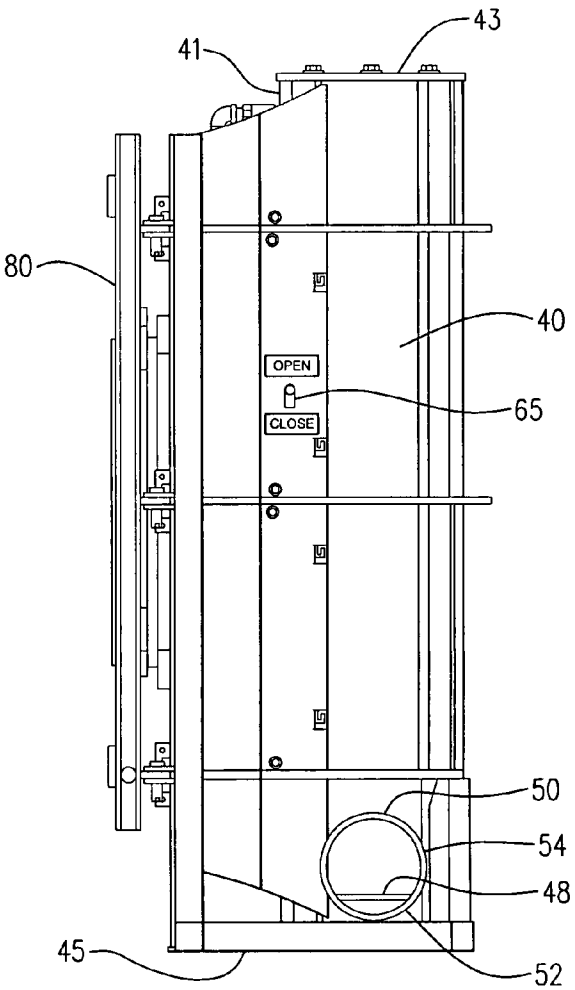
Figure 16:
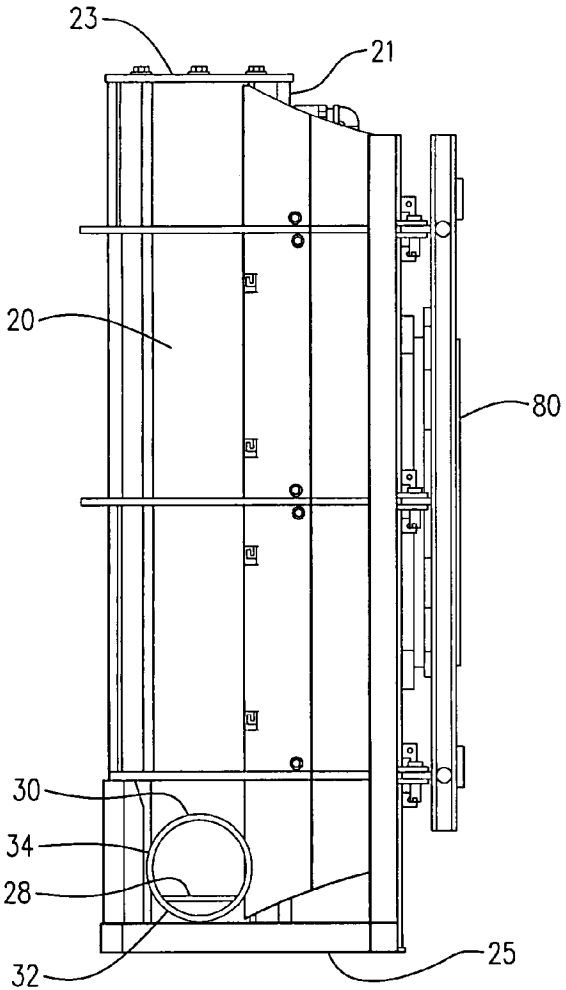

A pneumatic mud bucket 10 for the evacuation and diversion of drilling fluids from a pipe joint in a drill stem A on an active oilfield drilling rig, as shown in FIGS. 1-13 of the drawings, the pneumatic mud bucket 10 comprising a right half cylinder 20, a left half cylinder 40 hingably attached to one another by a plurality of hinges 75 extending from a rear surface 21, 41, of each half cylinder 20, 40, each half cylinder 20, 40, further defining an upper pipe aperture 23, 43, defining an upper circular opening 24, 44, and a lower piper aperture 25, 45, defining a lower circular opening 26, 46, conforming to the outer diameter of a drill stem A, each half cylinder 20, 40, further extending a plurality of extension arms 22, 42, the extension arms 22, 42, from each half cylinder 20, 40, being aligned in pairs, each pair hingeably attaching a respective air cylinder piston 68 receiving compressed air from a compressed air system 60 defining an air hose connection 62 connecting a compressed air line 64, FIG. 10, from an outer air supply, not shown, through an activation switch 65, FIGS. 11 and 13, each piston 68 retracting and extending to intentionally open and close the upper and lower pipe apertures 23, 25, 43 and 45, of each half cylinder 20, 40, around the drill stem A. Each right and left half cylinder 20, 40, further define a hollow cylindrical inner cavity 27, 47, a lower floor 28, 48, and a lower evacuation port 30, 50, in at least one of the half cylinders 20, 40, each at least one lower evacuation port 30, 50, extending from a lower portion 32, 52, of each hollow cylindrical inner cavity 27, 47, with each lower portion 32, 52, extending below the lower floor 28, 48, of each inner cavity 27, 47, FIGS. 3 and 5, for the complete evacuation of fluids from the inner cavities 27, 47, through each lower evacuation port 30, 50, each at least one lower evacuation port 30, 50, defining an outer collar 34, 54, which attaches an evacuation hose to direct the evacuated fluids to a drilling fluid recycling system, not shown.

Figure 1:
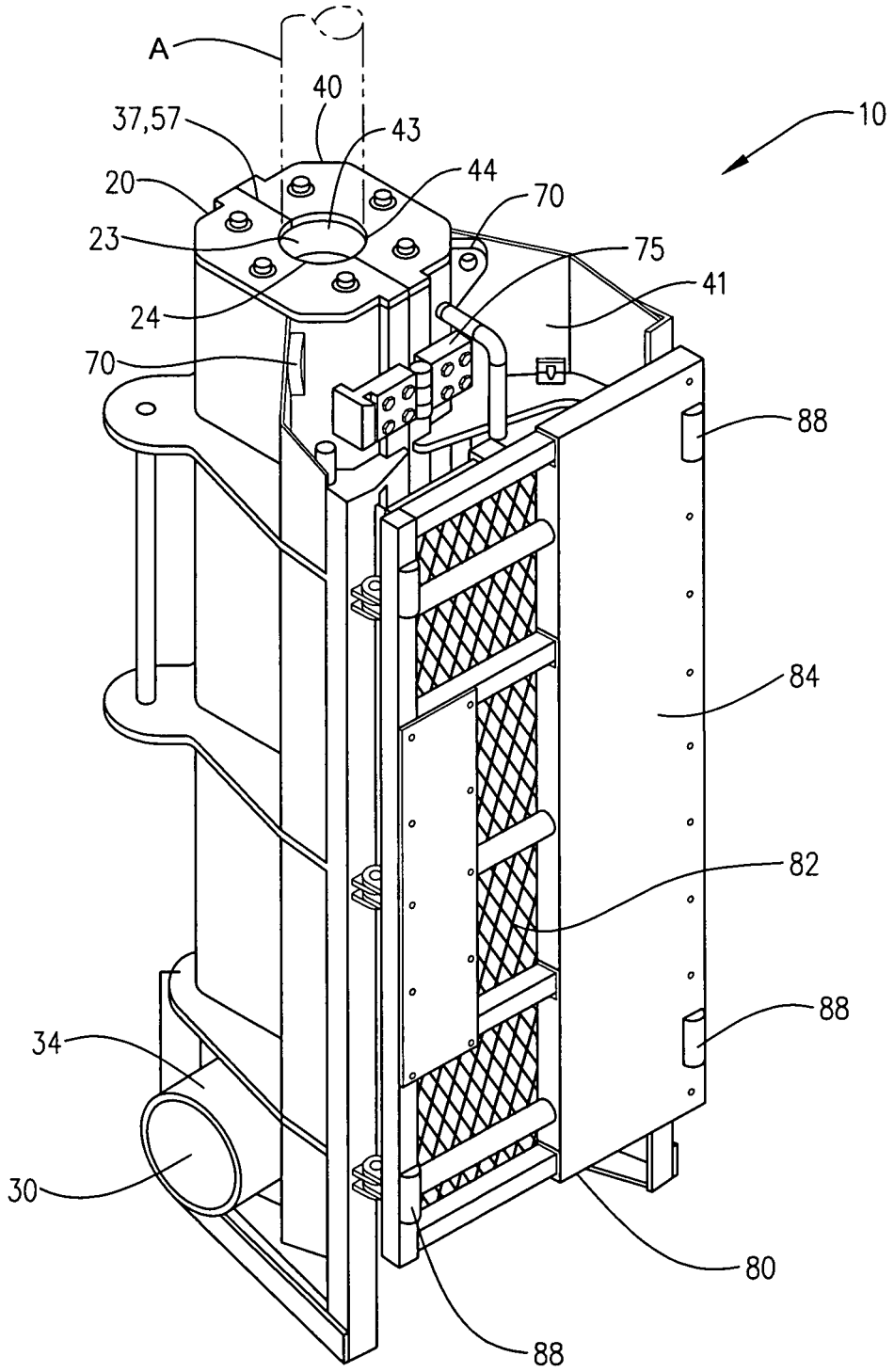
FIG. 1 is a rear perspective view of the pneumatic mud bucket.
Figure 4:
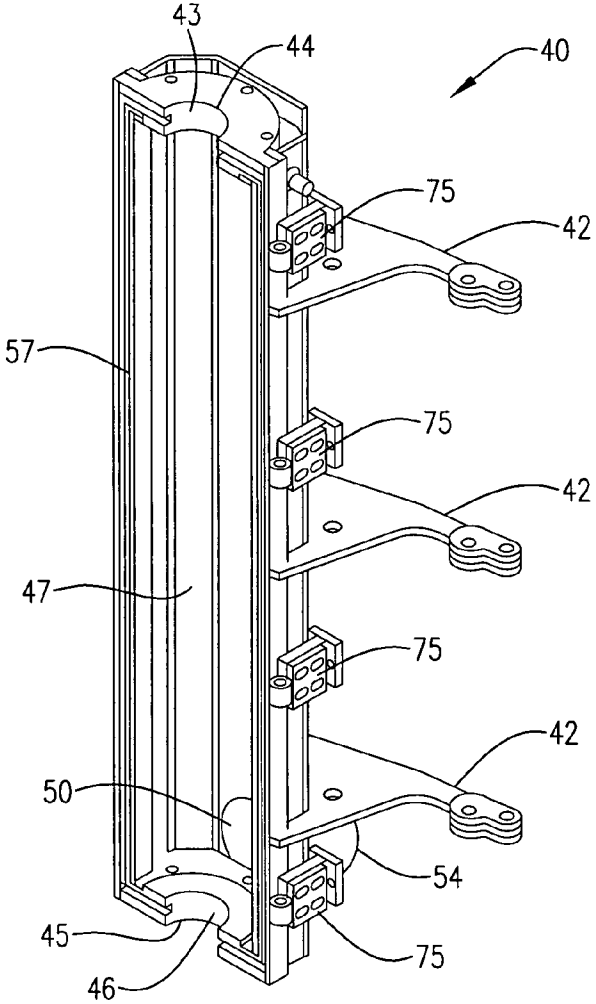
FIG. 4 is an upper perspective inner view of the left cylindrical shell.
Figure 5:
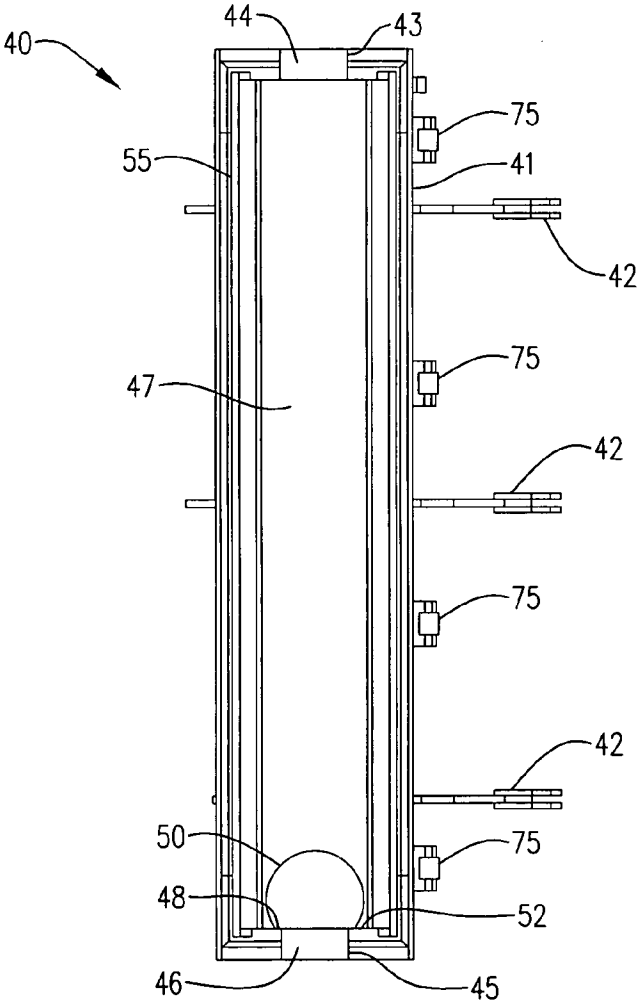
FIG. 5 is an inner view of the right cylinder shell.
Figure 5:
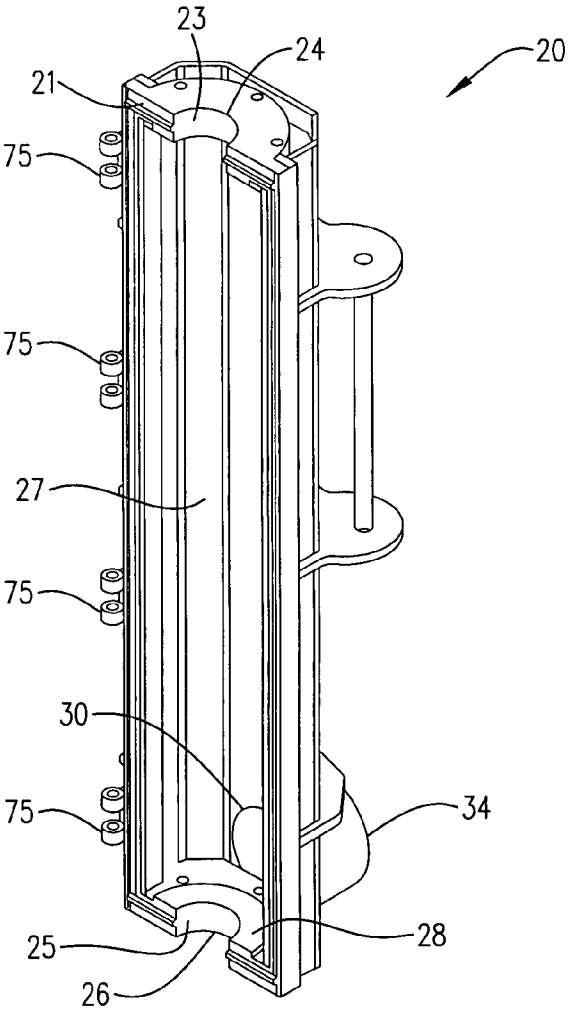
Figure 5:
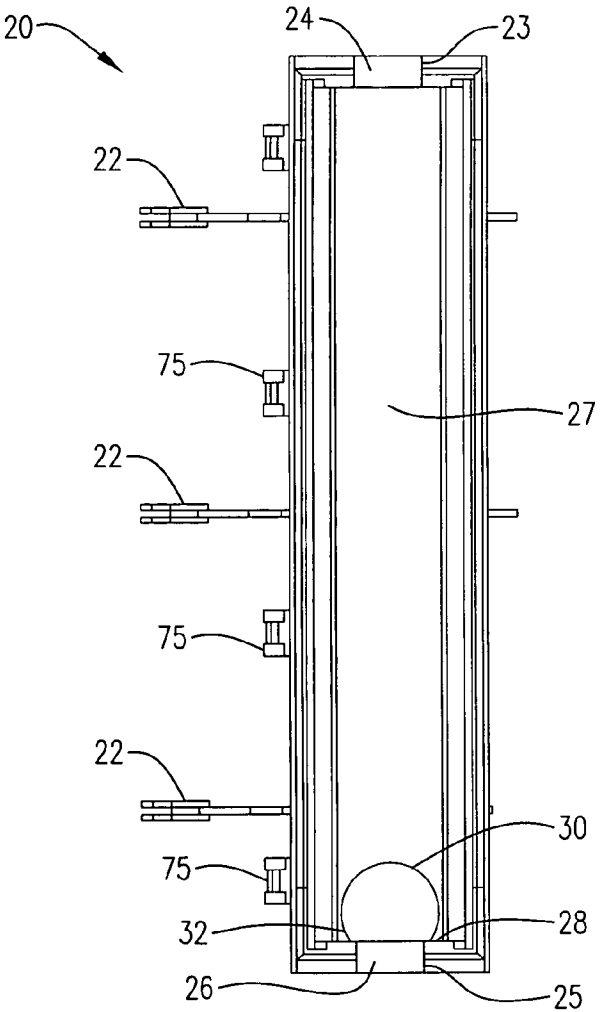
Figure 7:
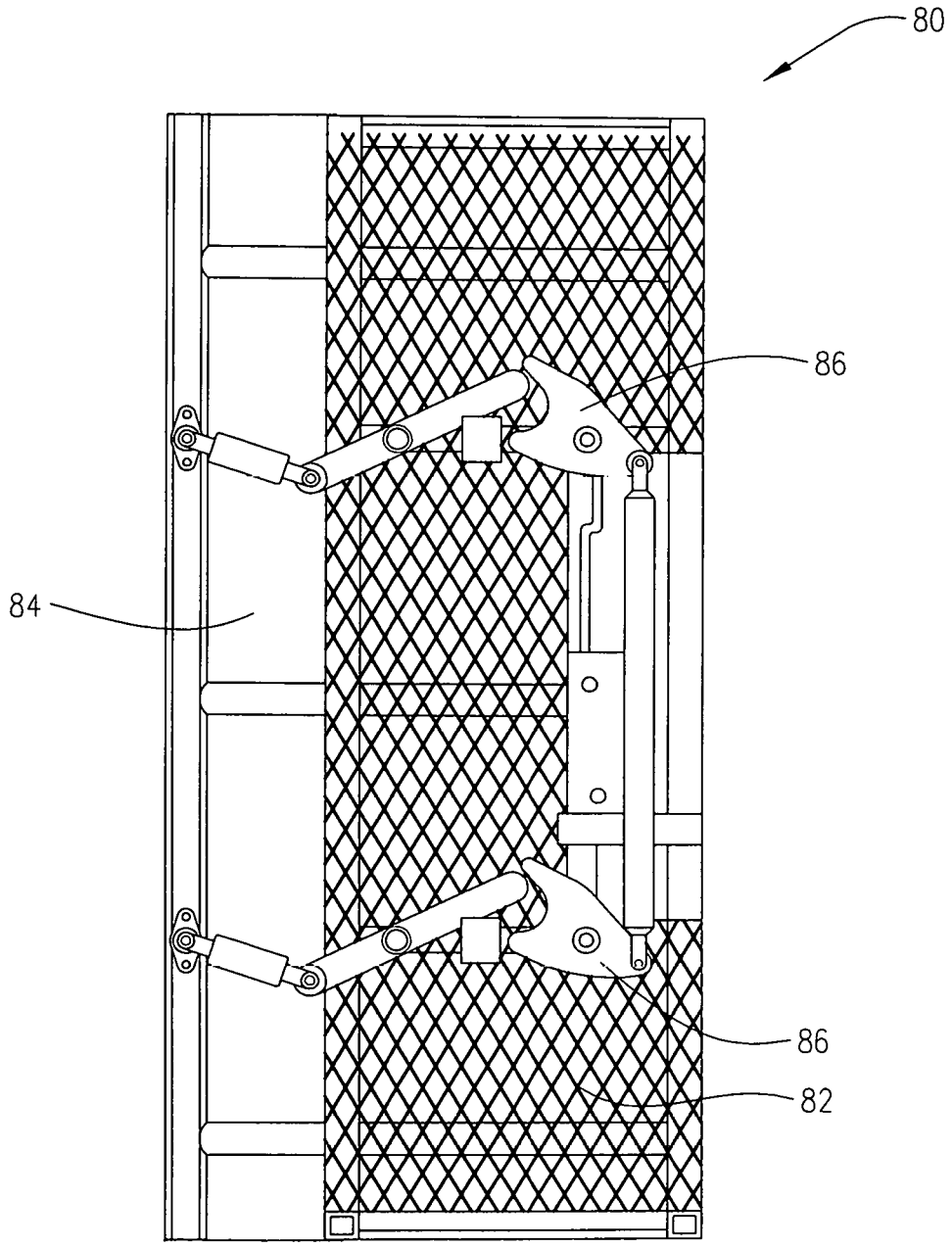
FIG. 7 is an front view of the rear safety screen assembly.
Figure 5:
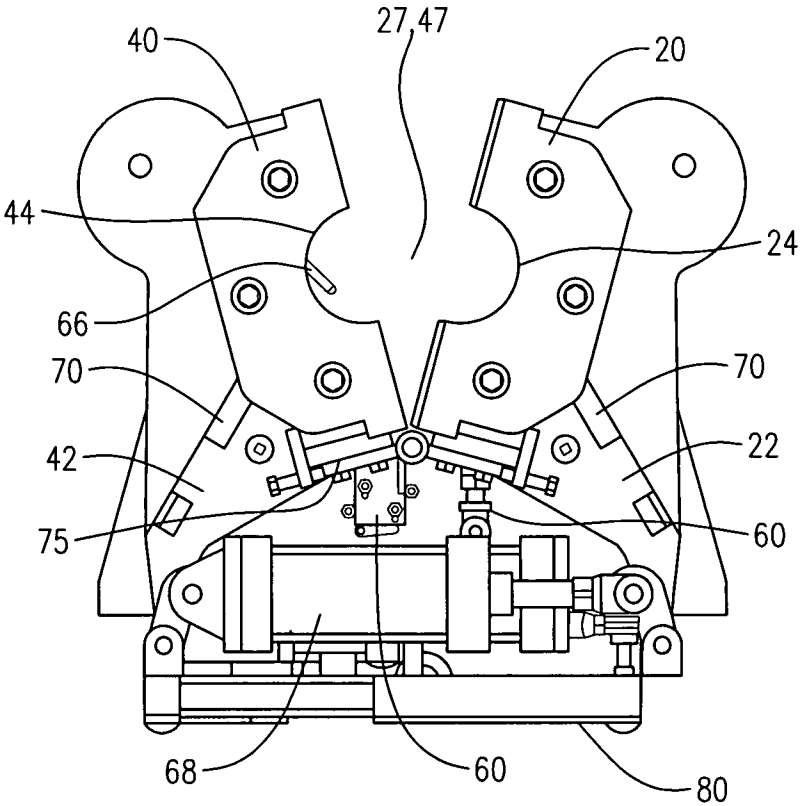
Figure 6:
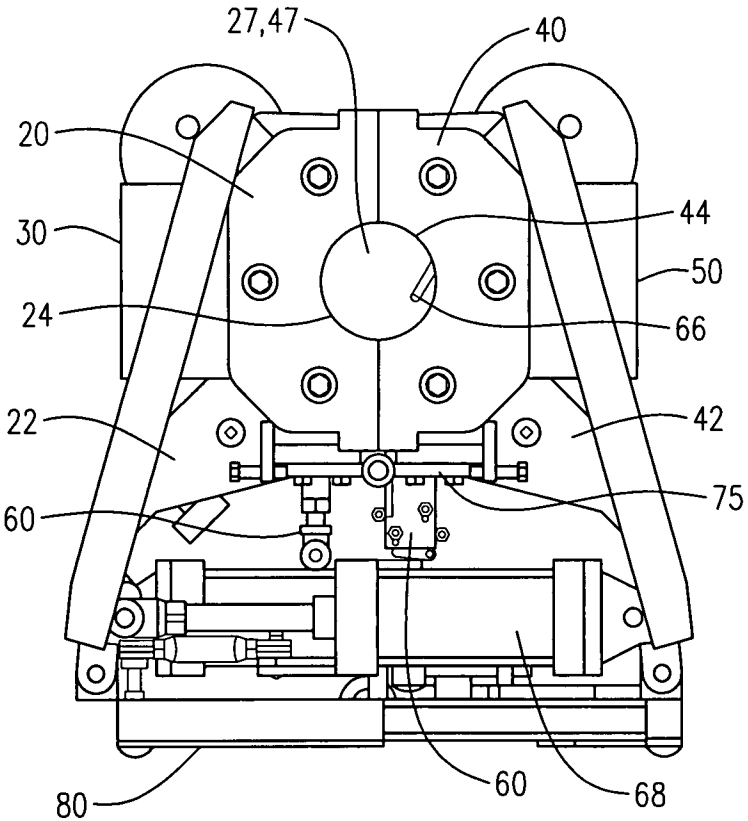
FIG. 6 is an upper perspective inner view of the right cylindrical shell.

Each half cylinder 20, 40, defines an inner perimeter groove 35, 55, FIGS. 4 and 6, within which is secured a perimeter seal 37, 57, made of a semi-compressible sealing material and extending slightly beyond each inner perimeter groove 35, 55, preventing the closed left and right half cylinders 20, 40, from releasing the drilling fluids from the inner cavities 27, 47, when secured and closed around the drill stem A at a pipe joint, FIG. 1. In one embodiment, the perimeter seal 27, 47, is provided on the perimeter of only one half cylinder, FIG. 3, with the perimeter seal fitted within the perimeter groove of the other opposing half cylinder, FIG. 5. A one way air pressure valve 66, FIG. 8, is included within at least one half cylinder to allow a positive pressure into the inner cavities 27, 47, introducing compressed air into the closed inner cavity from the compressed air system 60 to assist in the evacuation of the drilling fluids from the inner cavity through the at least one lower evacuation port 30, 50. When the left and right half cylinders 20. 40, are attached by the plurality of hinges 75, they form a vertical cylindrical clam-shell enclosure connected together by the plurality of hinges, the preferred embodiment defining the inclusion of at least four heavy duty hinges 75, each half cylinder extending three rear extension arms 22, 42, which align in pairs across the rear hinges 75, each aligned pair of extension arms hingeably attaching one of three pneumatic air cylinder pistons 68, each piston 68 alternating in horizontal orientation and further connected through the compressed air system 60 to the external compressed air system to supply each of the three pneumatic cylinders 68 with compressed air.

Figure 2:
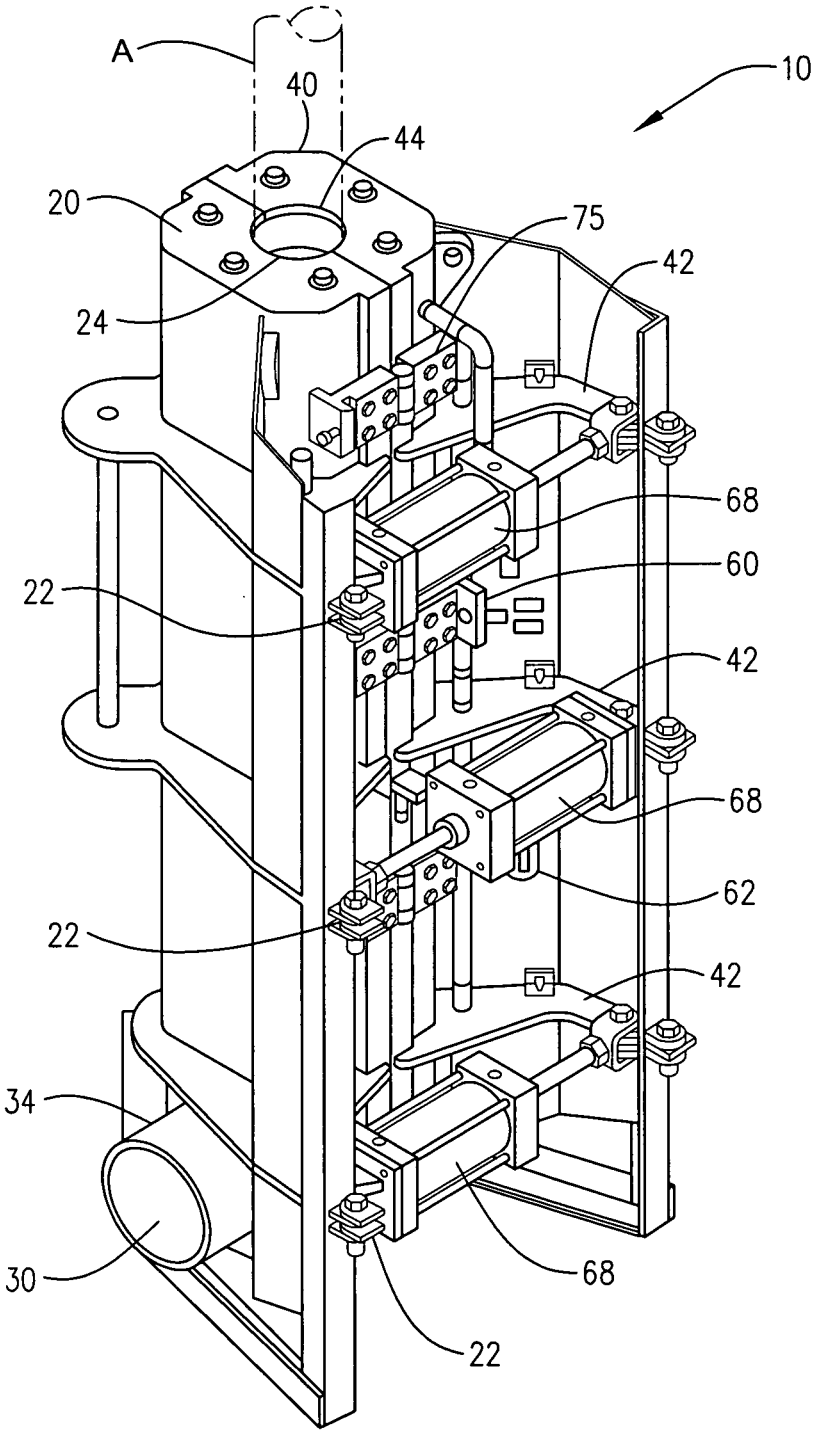
FIG. 2 is a rear perspective view of the pneumatic mud bucket with the rear safety screen assembly removed, exposing the air pistons, hinges and compressed air system with a phantom line indicating the drill stem which is contained within the mud bucket in a closed position.

Most preferably there is at least one more hinge 75 than pneumatic air cylinder pistons 68, and the hinges 75 are placed above and below each piston 68 as shown in FIGS. 2 and 10, to optimize the forces and improve the sealing capacity of the pneumatic mud bucket 10 assembly and to regulate the uniformity of the pressure of the perimeter seal 37, 57, over the entire mud bucket assembly and the inner perimeter seals of the right and left half cylinders 20, 40, from top to bottom. When the air pressure in the air pistons 68 are released, the pistons 68 contract against the rear extension arms 22, 42, and force the left and right half cylinders 20, 40, apart to open the pneumatic mud bucket 10 from around the pipe stem A. When the air pressure is applied and the pistons 68 are under pressure, the rear extension arms are pushed apart and the left and right cylinders 20, 40, are closed around the pipe stem. The closed position, FIG. 8, is the position at the time the pneumatic mud bucket 10 is attached to the drill stem A and the open position, FIG. 9, is the position when the pneumatic mud bucket 10 is release from the drill stem A.

It is preferred that the pneumatic mud bucket assembly be further equipped with a back guard assembly 80, shown in FIGS. 1, 7-9 and 12-13, providing a safe barrier secured between each set of extension arms 22, 42, on each half cylinder 20, 40, covering any exposure to the plurality of hinges 75, the cylindrical air pistons 68, the compressed air system 60 and any other rear components. This rear guard assembly 80, FIG. 7, comprises a screen panel 82, at least two spring tensioning support arms 86 and a solid cover panel 84 which is slidably engaged with the screen panel 82 to adjust the width of the back guard assembly 80 between the extension arms 22, 42, during the operation of the mud bucket 10 as it opens and closes. This back guard assembly 80 may be opened and closed by at least two hinges 88, FIG. 7, for servicing of the hinges 75, the pistons 68, the compressed air system 60 and for cleaning and routine servicing.

The pneumatic mud bucket 10 is generally suspended from the drilling rig and may be swung or otherwise moved into place by an overhead chain system or other suspensory system, or by some movement in relationship to the drilling platform deck. A pair of overhead chain brackets 70 are shown in FIG. 1. In whatever manner provided, the support apparatus used to move and remove the pneumatic mud bucket, in a location proximity to an outside compressed air supply and a mud evacuation hose.

While the invention has been particularly shown and described with reference to a preferred embodiment thereof, it will be understood by those skilled in the art that changes in form and detail may be made therein without departing from the spirit and scope of the invention.

What is claimed is:

1. A pneumatic mud bucket for the containment, evacuation and diversion of drilling fluids from a pipe joint in a drill stem utilized in a drilling rig, the pneumatic mud bucket comprising:

a right half cylinder defining a rear surface extending a plurality of extension arms, an upper pipe aperture, a lower piper aperture, a hollow cylindrical inner cavity defining a lower floor and an inner perimeter groove, and an evacuation port having a lower portion extending below said lower floor, said evacuation port further defining an outer collar;

a left half cylinder defining a rear surface extending a plurality of extension arms, an upper pipe aperture, a lower piper aperture, a hollow cylindrical inner cavity defining a lower floor and an inner perimeter groove, and an evacuation port having a lower portion extending below said lower floor, said evacuation port further defining an outer collar;

a perimeter seal in at least one of said perimeter groove extending slightly beyond said inner perimeter groove, said right and left half cylinder attached together forming a clamshell enclosure by a plurality of hinges attaching to said rear surfaces of said respective right and left half cylinders mating together along said respective perimeter grooves, said upper pipe apertures forming an upper circular opening receiving a section of drill stem and said lower pipe apertures forming a lower circular opening receiving a section of the same said drill stem, with said perimeter seal preventing released drilling liquids from escaping each said hollow cylindrical inner cavities when said mud bucket is in a closed position around said drill stem, diverting said liquids to said evacuation ports;

a compressed air system attaching to said rear surfaces of said right and left half cylinders, said compressed air system defusing an air hose connection attaching a compressed air line from an external compressed air supply, an activation switch to deliver compressed air to at least one cylindrical piston attaching between at least one aligned pair of extension arms of each right and left half cylinder to open and close said right and left half cylinder around said drill stem;

a one way air pressure valve located with at least one right or left half cylinder, further attaching to said compressed air system to introduce pressurized air into said hollow inner cavity providing a positive pressure within said hollow inner cavity of each said right and left half cylinder in a closed position around a drill stem, assisting in the evacuation of drilling liquids from said inner cavities, over said lower floors and out said evacuation ports; and a bracket mounted to each half cylinder around said upper pipe aperture from which to suspend said mud bucket.

2. The pneumatic mud bucket as disclosed in claim 1, further defining a back guard assembly providing a safe barrier secured between each set of said plurality of extension arms preventing incidental exposure to said plurality of hinges, said at least one cylindrical air piston, and said compressed air system comprising:

a screen panel;

at least two tensioning support arms; and a solid cover panel slidably engaged with said screen panel to adjust a width of said back guard assembly between said extension arms during operation of said mud bucket as it opens and closes, said back guard assembly opened and closed by at least two hinges attaching to at least two said extension arms, providing access to service and repair said plurality of hinges, said at least one air piston, said compressed air system and for cleaning and routine servicing.

3. The pneumatic mud bucket, as disclosed in claim 1, said mud bucket more specifically comprising:

three extension arms extending from each said right and left half cylinder;

four hinges attaching said rear surfaces of each said right and left half cylinder forming said clamshell enclosure of said mud bucket; and one air cylinder hingeably attached between each paired and aligned set of extension arms to open and close said right and left half cylinders, each said air cylinder receiving said supply of compressed air from said compressed air system through said activation switch, with each said air cylinder alternating in horizontal orientation and positioned between a set of hinges along said rear surface of said right and left half cylinders to optimize closure forces and to provide uniformity of pressure upon said perimeter seal from top to bottom.

* * * * *